US012078439B2

(12) United States Patent
Curry

(10) Patent No.: US 12,078,439 B2
(45) Date of Patent: Sep. 3, 2024

(54) BACK STRAP AND GRIP FRAME EXTENDER

(71) Applicant: Smith & Wesson Inc., Springfield, MA (US)

(72) Inventor: Brett Curry, Monson, MA (US)

(73) Assignee: SMITH & WESSON INC., Springfield, MA (US)

( * ) Notice: Subject to any disclaimer, the term of this patent is extended or adjusted under 35 U.S.C. 154(b) by 0 days.

(21) Appl. No.: 18/115,039

(22) Filed: Feb. 28, 2023

(65) Prior Publication Data

US 2023/0272988 A1 Aug. 31, 2023

Related U.S. Application Data

(60) Provisional application No. 63/314,592, filed on Feb. 28, 2022.

(51) Int. Cl.
*F41A 3/66* (2006.01)
*F41A 19/44* (2006.01)
*F41C 23/10* (2006.01)

(52) U.S. Cl.
CPC ..... *F41A 3/66* (2013.01); *F41A 19/44* (2013.01)

(58) Field of Classification Search
CPC ..... F41C 23/10; F41C 23/12; F41A 3/66
USPC ..... 42/71.02, 7
See application file for complete search history.

(56) References Cited

U.S. PATENT DOCUMENTS

| | | | |
|---|---|---|---|
| 1,333,618 | A | 3/1920 | Hegerhor |
| 1,367,043 | A | 2/1921 | Haskell |
| 4,570,370 | A | 2/1986 | Smith et al. |
| 5,231,237 | A | 7/1993 | Cupp |
| 5,621,995 | A | 4/1997 | Smith |
| 10,066,885 | B2 | 9/2018 | Chen |
| 10,260,828 | B2 | 4/2019 | Harrigan et al. |
| 10,415,919 | B1 | 9/2019 | Harrigan et al. |
| 10,809,025 | B2 | 10/2020 | Harrigan et al. |
| 10,809,036 | B2 | 10/2020 | Harrigan et al. |
| 10,948,262 | B2 | 3/2021 | Curry et al. |
| 10,955,204 | B2 | 3/2021 | Harrigan et al. |
| 11,022,388 | B1 | 6/2021 | Noonan et al. |
| 11,079,189 | B2 | 8/2021 | Hsu |
| 2013/0139426 | A1 | 6/2013 | Baxley |
| 2021/0172702 | A1 | 6/2021 | Harrigan et al. |
| 2021/0341236 | A1 | 11/2021 | Hsu |

*Primary Examiner* — Reginald S Tillman, Jr.
(74) *Attorney, Agent, or Firm* — Ballard Spahr LLP

(57) ABSTRACT

A combination back strap and grip extender mountable on a grip of a firearm. The grip defines a magazine well. The combination comprises a strap positionable lengthwise along and overlying an anterior portion of said grip. The strap has first and second ends oppositely disposed. The first and second ends are removably attachable to said grip. The grip extender is mounted on said second end of said strap. The grip extender comprises a collar defining a lumen aligned with said magazine well when said strap overlies said grip.

19 Claims, 8 Drawing Sheets

BACK STRAP AND GRIP FRAME EXTENDER

CROSS-REFERENCE TO RELATED APPLICATION

This application claims the benefit of the filing date of U.S. Provisional Patent Application No. 63/314,592, filed Feb. 28, 2022, the entirety of which is hereby incorporated by reference herein.

FIELD

This disclosure concerns interchangeable back straps and grip frame extenders for firearms such as pistols.

BACKGROUND

Interchangeable back straps often require the use of fasteners in the form of screws, pins or types of pivoting or sliding removable fasteners to retain the back strap to the firearm frame. Furthermore, known grip extenders are separate components which may not be useable with interchangeable back straps.

As explained further below, it would be advantageous if retention of the back strap could be realized without the use of additional fasteners and if interchangeable back straps were useable with grip extenders.

SUMMARY OF EMBODIMENTS

Disclosed herein is a combination back strap and grip extender mountable on a grip of a firearm. The grip defines a magazine well. The combination comprises a strap positionable lengthwise along and overlying an anterior portion of said grip. The strap has first and second ends oppositely disposed. The first and second ends are removably attachable to said grip. The grip extender is mounted on said second end of said strap. The grip extender comprises a collar defining a lumen aligned with said magazine well when said strap overlies said grip.

Also disclosed is a firearm having a frame defining a grip defining a magazine well and said combination back strap and grip extender removably mounted on said grip.

In some aspects, said firearm can further comprise a hammer strut, a cup, and a mainspring positioned within said grip. The mainspring acts between said hammer strut and said cup. A plunger is mounted on said cup and extends through an aperture in said grip.

According to some embodiments, said firearm further comprises a spur projecting from said first end of said strap and an aperture positioned in said second end of said strap. The spur engages a recess in said frame. The aperture receives said plunger. Engagement of said spur with said frame and said plunger with said aperture retains said combination to said grip.

In exemplary aspects, the aperture is defined by a lug projecting from said second end of said strap.

In exemplary embodiments, the lug comprises a ramp surface surrounding said aperture. The ramp surface faces said plunger when said grip strap is retained to said grip.

In various aspects, the firearm further comprises a plate mounted on said grip. The plate defines said aperture.

In some aspects the plate has a plate surface facing said mainspring. The plate surface surrounds said opening and defines a line of motion along which said plunger moves, such that movement of said plunger toward said mainspring compresses said mainspring.

In exemplary embodiments, the mainspring comprises a coil spring surrounding an axis oriented parallel to said line of motion of said plunger.

In some examples, the axis is coaxially aligned with said line of motion.

Also disclosed is a method of attaching said combination back strap and grip extender to said grip of said firearm. The method comprises engaging a spur extending from a first end of a strap with a recess in said grip. The method also comprises rotating said combination about said spur toward said grip. The method further comprises engaging an aperture positioned in a grip extender with a plunger extending from an opening in said grip.

In some aspects, the method can further comprise biasing said plunger into engagement with said aperture using a mainspring of a trigger strut positioned within said grip.

In exemplary aspects, the method further comprises moving said plunger toward said mainspring by engaging said plunger with a ramp surface mounted on said grip extender upon rotating said combination about said spur toward said grip.

Also disclosed is a method of removing said combination back strap and grip extender from said grip of said firearm. The method comprises moving a plunger out of engagement with an aperture positioned in a grip extender. The method also comprises rotating said combination away from said grip about a spur extending from a first end of a strap, said spur being engaged with a recess in said grip. The method further comprises removing said spur from engagement with said recess.

In exemplary embodiments, the method comprises moving said plunger out of engagement with said aperture by compressing a mainspring of a trigger strut positioned within said grip.

In some further aspects, moving said plunger comprises inserting a tool into said aperture and engaging said plunger with said tool.

It is contemplated that the disclosed embodiments can retain the back strap without the use of additional fasteners and/or provide interchangeable back straps that are useable with grip extenders. Thus, in use, it is contemplated that the disclosed embodiments can allow the grip of a firearm to be easily modified by the removal and attachment of grip straps of different sizes to accommodate different sized hands as well as to accommodate different size magazines to allow increase or decrease of ammunition capacity as desired.

DETAILED DESCRIPTION

Figure 1:
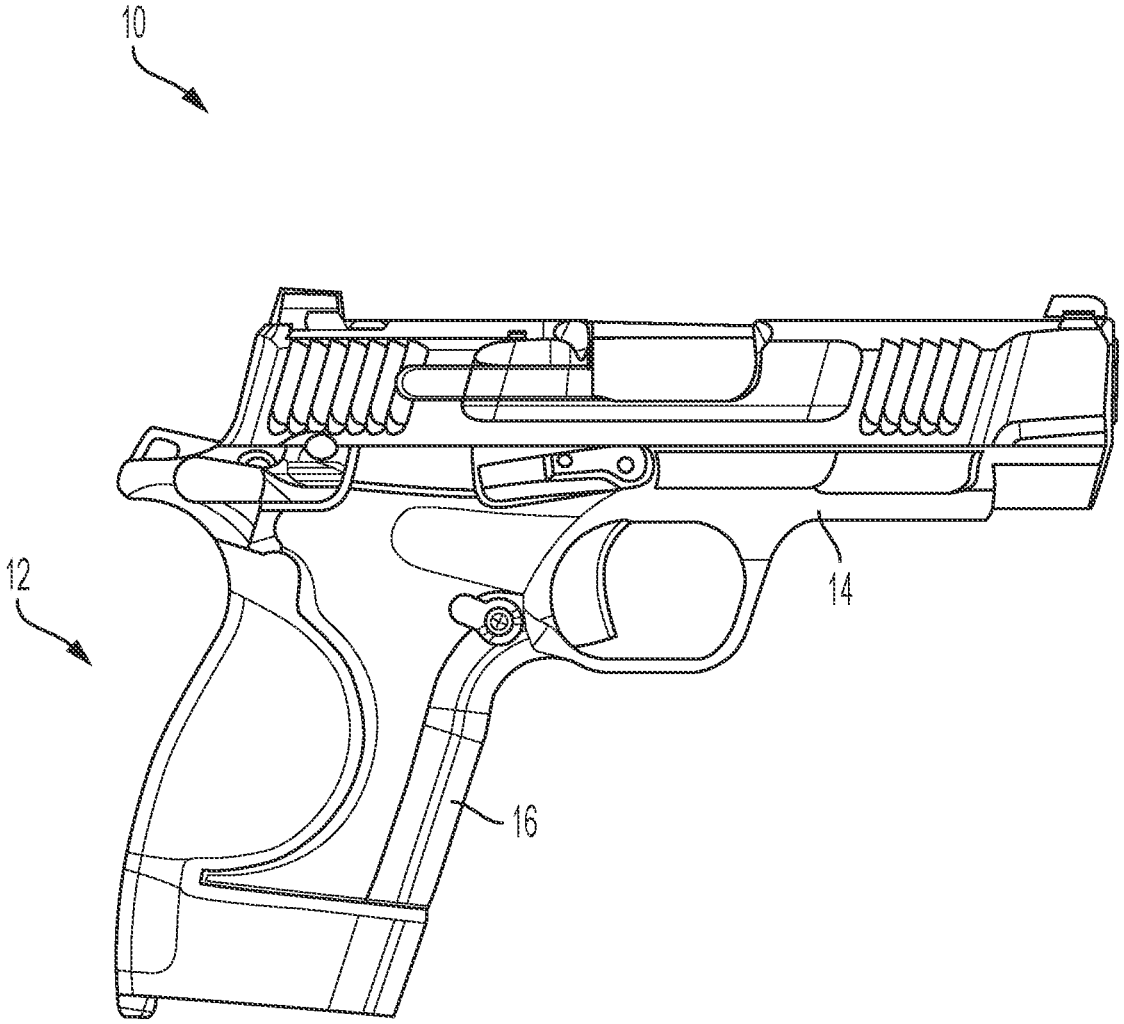
FIG. 1 is a side view of an example pistol and combination back strap and grip extender as disclosed herein.
Figure 2:
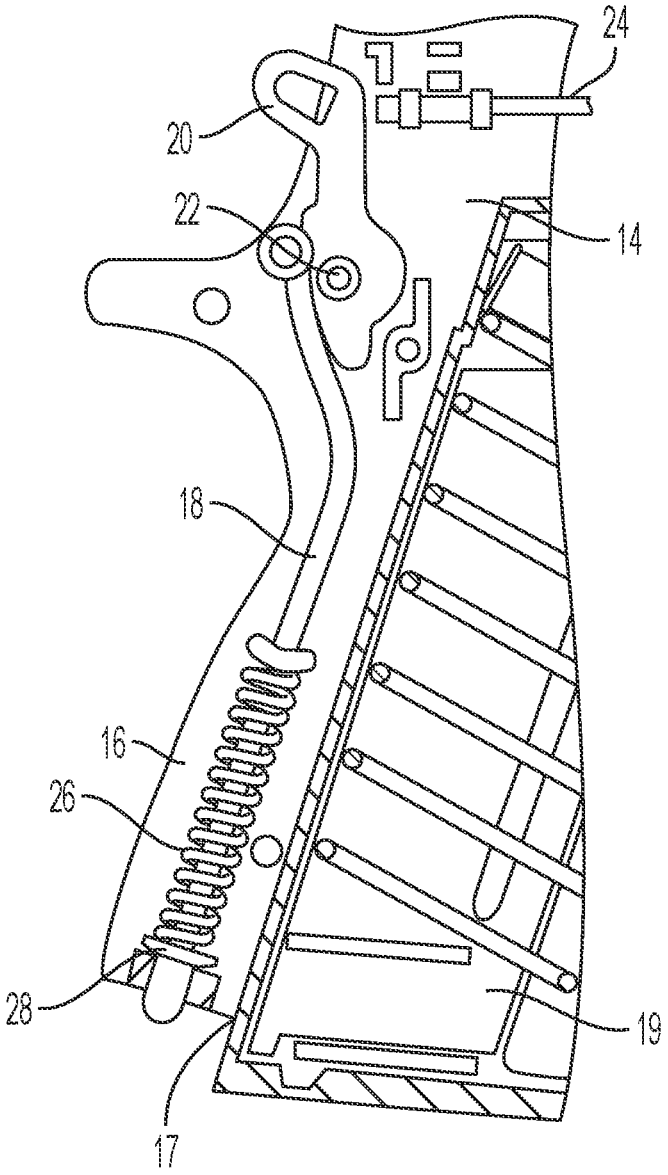
FIG. 2 is a partial sectional view of the pistol in FIG. 1.
Figure 3:
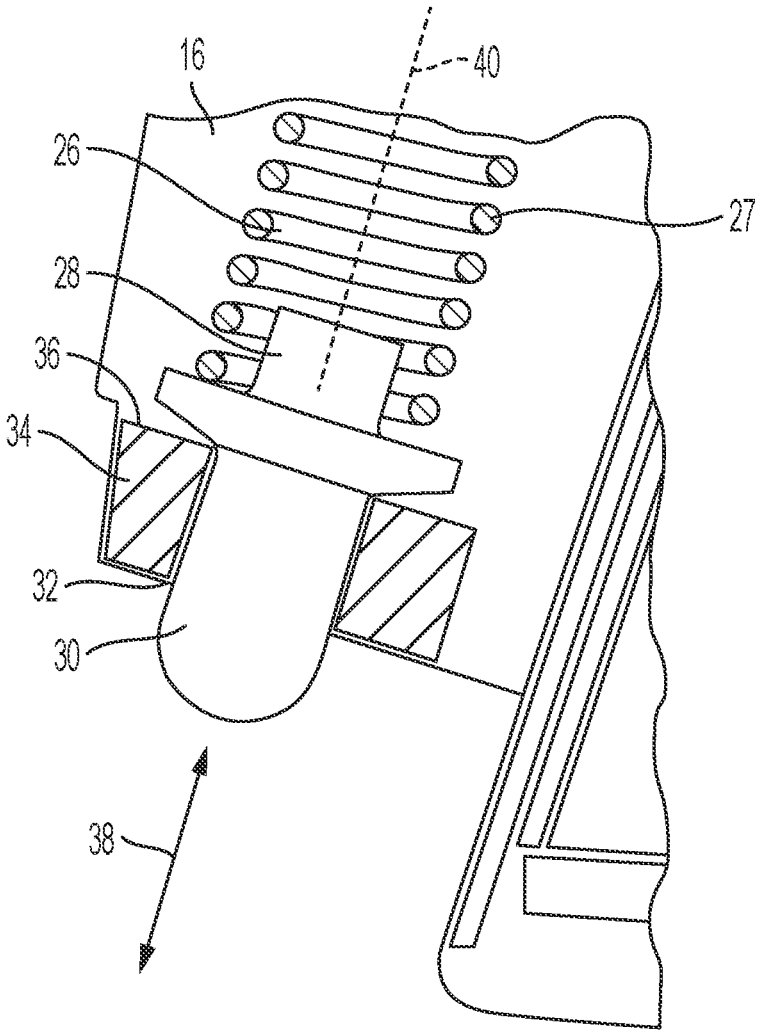
FIG. 3 is a detailed view of a portion of the pistol of FIG. 1 shown on an enlarged scale.

FIG. 1 shows an example firearm 10 and combination back strap and grip extender 12. In this example, firearm 10 comprises a semiautomatic pistol having a frame 14 defining a grip 16. As shown in FIG. 2, grip 16 defines a magazine well 17 which receives a magazine 19. A hammer strut 18 is positioned within the grip 16. The hammer strut 18 is pivotably connected to a hammer 20 which pivots about an axis 22 on frame 14 to strike a firing pin 24 to discharge firearm 10 when a trigger is pulled. The force necessary to pivot hammer 20 is provided by a mainspring 26. Mainspring 26 is positioned within grip 16 and acts between the hammer strut 18 and a cup 28, also positioned within the grip. Cup 28 helps to retain and stabilize mainspring 26 within the grip 16. As shown in FIG. 3, a plunger 30 is mounted on cup 28 and extends in a direction opposite to the mainspring 26 through an opening 32 in the grip 16. In this example embodiment, the opening 32 is defined by a plate 34 mounted on the grip 16. Plate 34 has a plate surface 36 which faces mainspring 26 and surrounds opening 32. Opening 32 defines a line of motion 38 along which plunger 30 moves. In this example embodiment, mainspring 26 comprises a coil spring 27 surrounding an axis 40 which is coaxially aligned with the line of motion 38 of plunger 26. Motion of plunger 26 along the line of motion 38 toward the mainspring 26 compresses the mainspring, which biases both the plunger 30 and the hammer strut 18.

Figure 4:
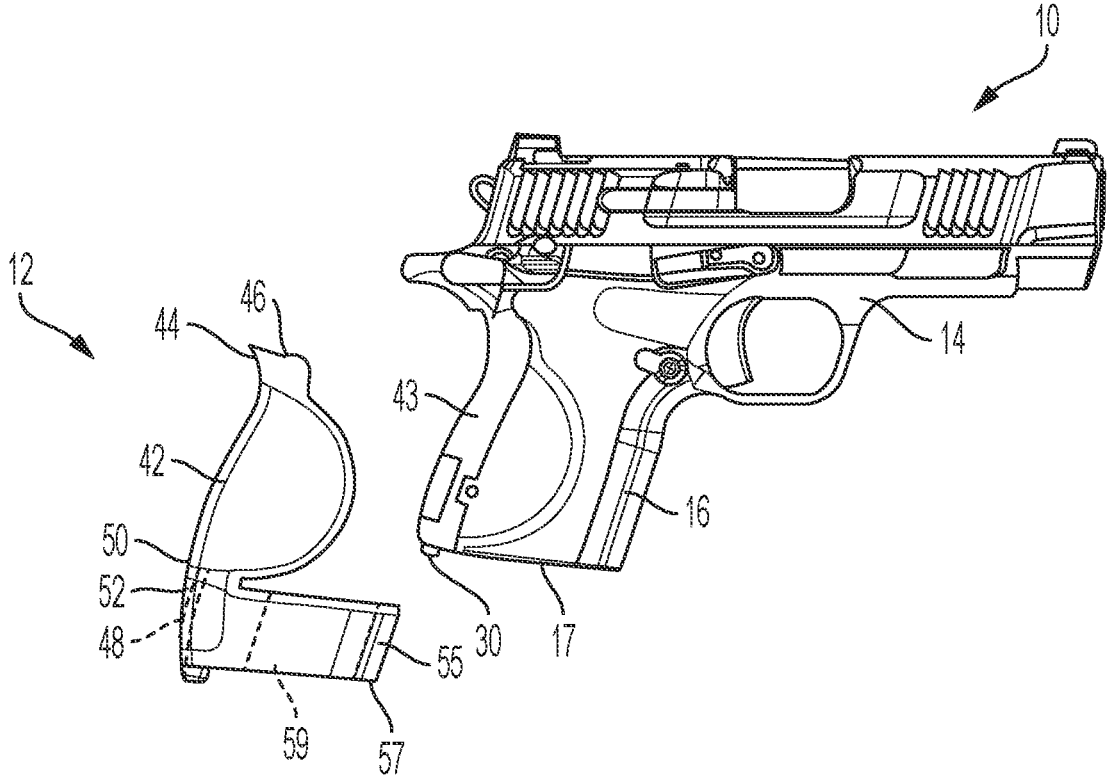
FIG. 4 is a side view of an example combination back strap and grip extender as disclosed herein.

FIG. 4 shows an example combination back strap and grip extender 12 which is removably positionable on grip 16. Combination 12 comprises a strap 42 which overlies an anterior portion 43 of the grip 16. A spur 44 projects from a first end 46 of the strap 42, and an aperture 48 (see also FIG. 7) is positioned in a second end 50 of the strap 42. In this example, the aperture 48 is defined by a lug 52 which projects from the second end 50 of the strap 42. As shown in FIG. 8, lug 52 comprises a ramp surface 54 which faces the plunger 30 when the combination 12 is positioned on the grip 16. Engagement of the spur 44 with frame 14 and the aperture 48 with the plunger 30 removably retains the combination back strap and grip extender 12 to the grip 16 as described below.

FIG. 4 also shows the grip extender 55 which is mounted on the second end 50 of the strap 42. Grip extender 55 comprises a collar 57. Collar 57 defines a lumen 59 which aligns with the magazine well 17 when the strap 42 overlies the grip 16. Lumen 59 of the grip extender 55 allows the firearm 10 to receive a longer magazine than intended in the absence of the extender.

Figure 5:
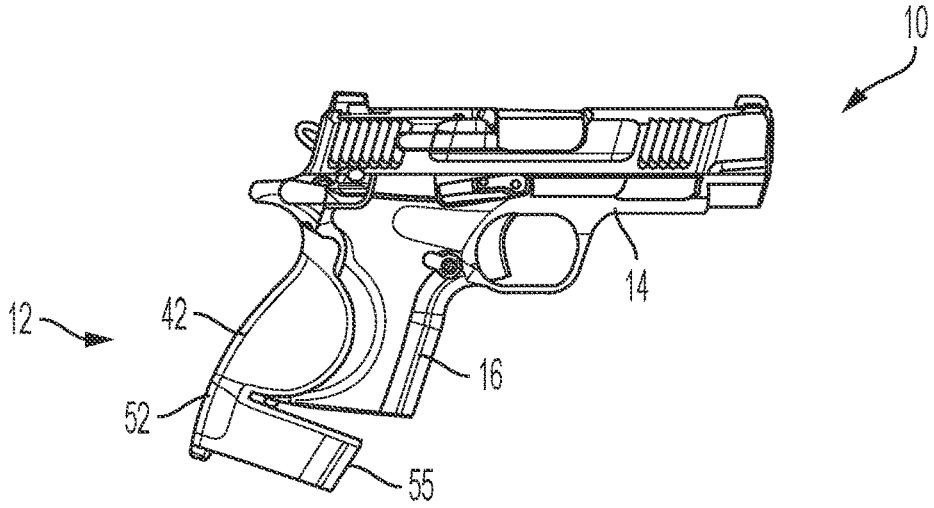
FIGS. 5, 6 and 7 illustrate an example method of attaching a combination back strap and grip frame extender to a pistol.
Figure 6:
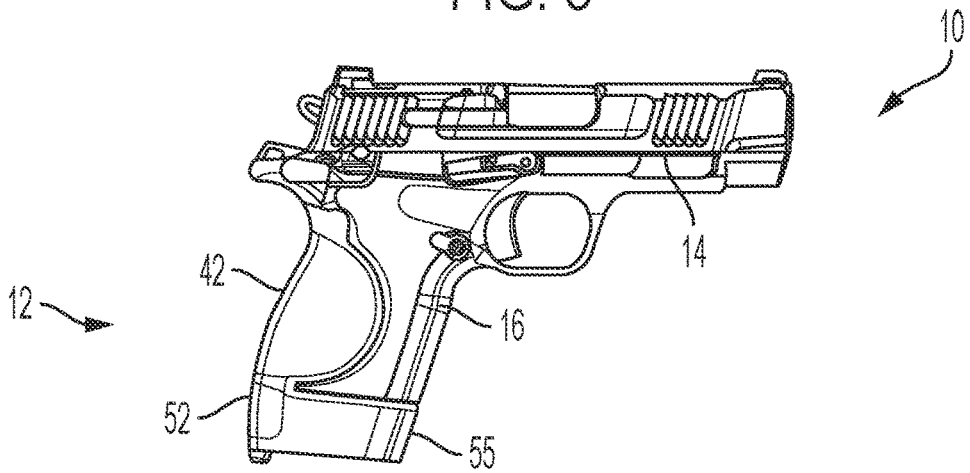
Figure 7:
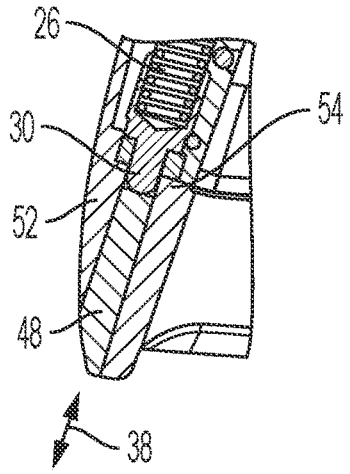
Figure 8:
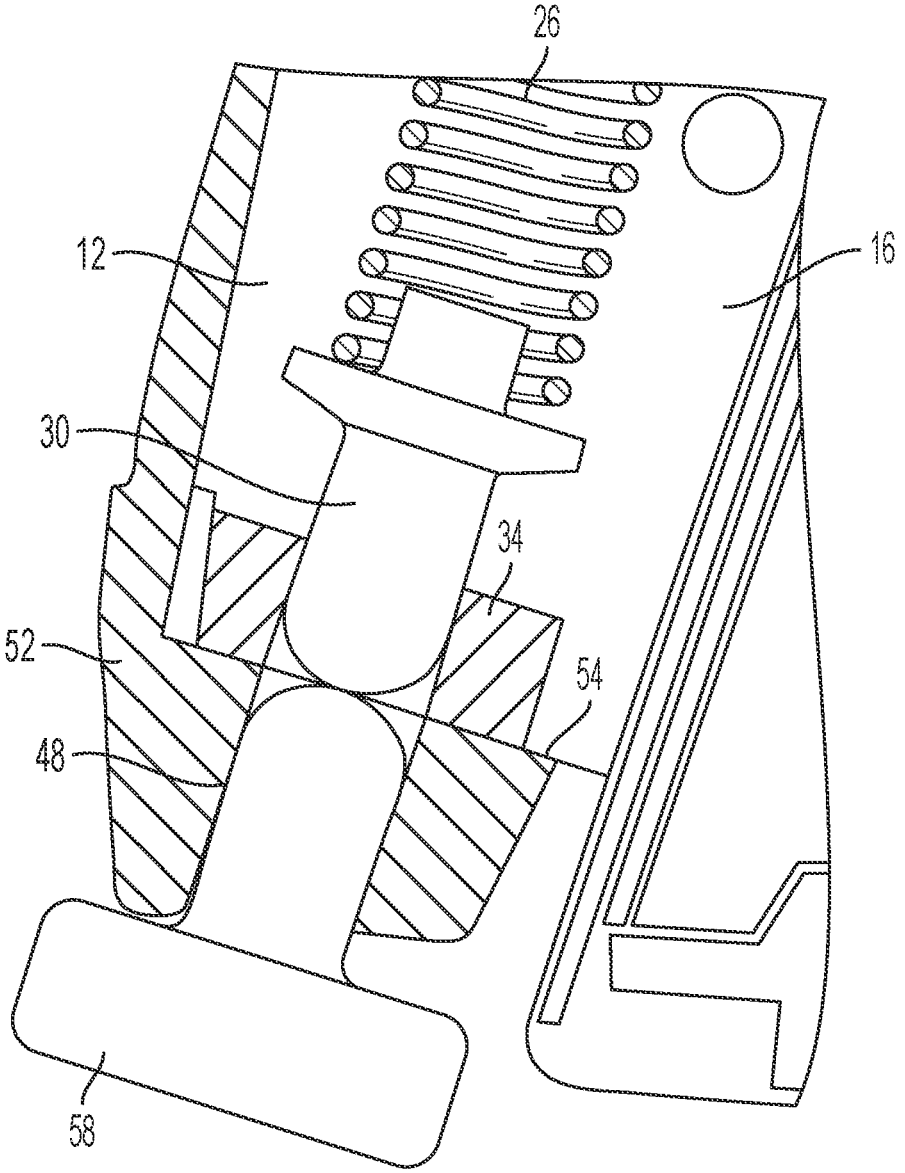
FIGS. 8, 9 and 10 illustrate an example method of removing a combination back strap and grip frame extender from a pistol.
Figure 10:
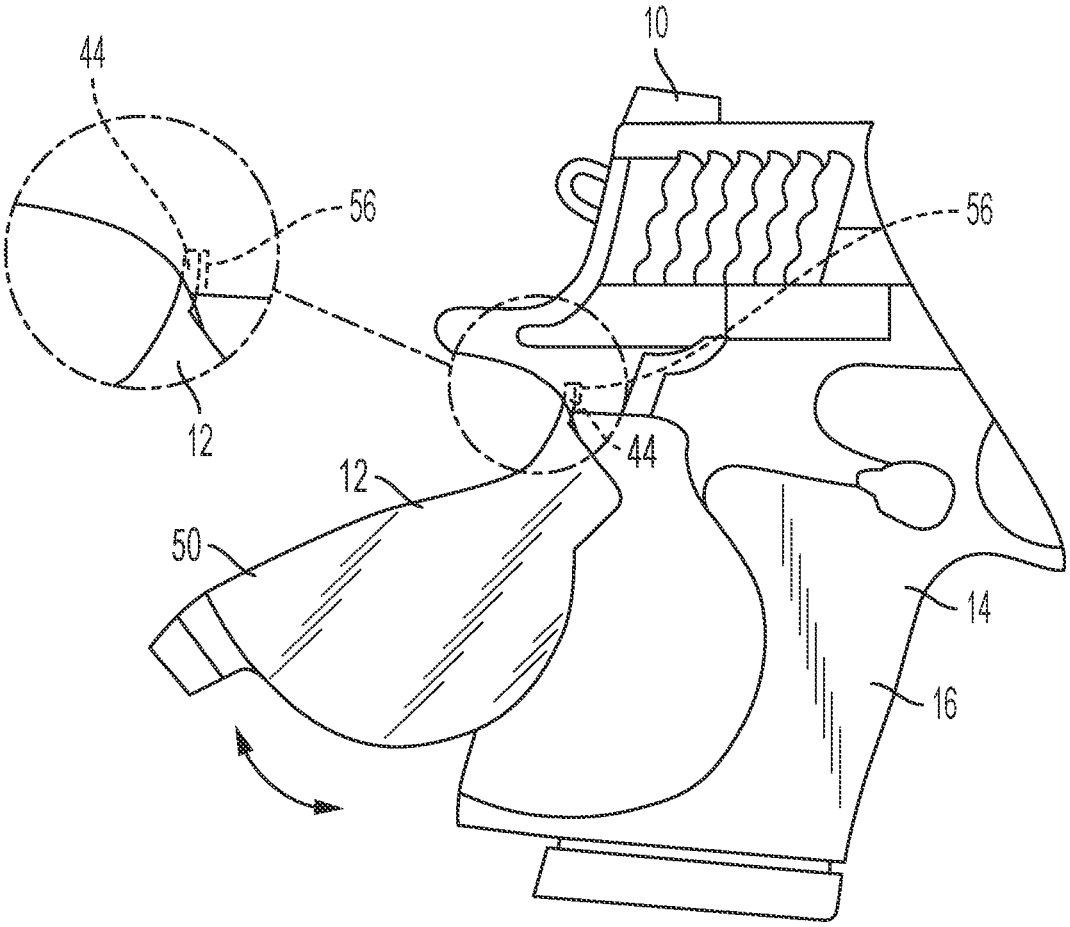

FIGS. 5-7 and 10 illustrate an example method of attaching the grip strap 12 to the firearm 10. As shown in FIGS. 5 and 10, the combination back strap and grip extender 12 is positioned such that the spur 44 engages a recess 56 in the grip 16. Combination 12 is then rotated about spur 44 toward the grip 16. As shown in FIGS. 5 and 7, lug 52 is positioned such that upon rotation of the combination 12, the ramp surface 54 engages plunger 30 and moves the plunger along the line of motion 38, compressing the biasing mainspring 26. As shown in FIGS. 6 and 7, once the aperture 48 aligns sufficiently with the plunger 30 the mainspring 26 biases the plunger into engagement with the aperture 48. The plunger 30 and lug 52 cooperate with the spur 44 and recess 56 to securely retain the combination 12 to the grip 16.

Figure 9:
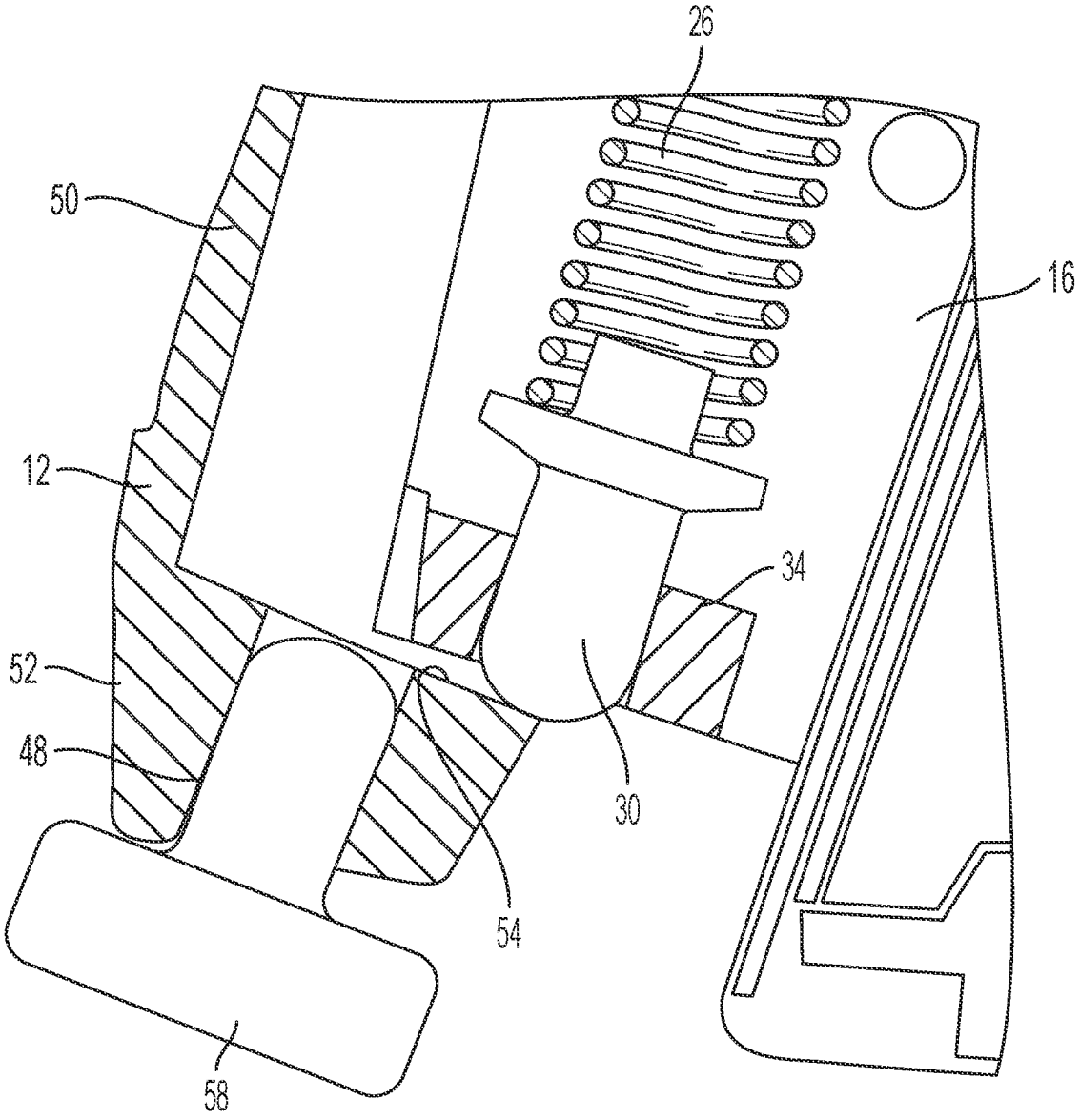

FIGS. 8-10 illustrate an example method for removing the combination back strap and grip extender 12 from the firearm 10. As shown in FIG. 8, a tool 58 is inserted into the aperture 48 of lug 52 sufficient to move the plunger 30 against the biasing force of mainspring 26 and out of engagement with the aperture. As shown in FIGS. 9 and 10, the combination 12 may now be rotated away from the grip 16 to disengage the second end 50 of the strap 42 from the grip 16. Both the tool 58 and the plunger 30 may have rounded heads to permit easy relative motion between the strap 42 and the grip 16. As shown in FIG. 10, the spur 44 is next disengaged from recess 56 to remove the combination 12 from the grip 16.

It is expected that the disclosed firearm and combination back strap and grip extender, which uses the hammer strut mainspring to bias the plunger as well as the hammer strut, can provide a simpler way to modify the grip of a firearm to accommodate different users and different size magazines.

What is claimed is:

1. A combination back strap and grip extender mountable on a grip of a firearm, said grip defining a magazine well and having an anterior portion, said combination comprising:

a strap positionable lengthwise along and overlying said anterior portion of said grip, said strap having first and second ends oppositely disposed, said first and second ends being removably attachable to said grip, said strap comprising an aperture positioned in said second end of said strap; and a grip extender mounted on said second end of said strap, said grip extender comprising a collar defining a lumen aligned with said magazine well when said strap overlies said grip.

2. The combination according to claim 1, wherein said strap further comprises a spur projecting from said first end of said strap, said spur being adapted to engage a recess within a frame of said firearm.

3. The combination according to claim 1, wherein said aperture is defined by a lug projecting from said second end of said strap.

4. The combination according to claim 3, wherein said lug comprises a ramp surface surrounding said aperture.

5. A firearm comprising:

a frame defining a grip, said grip defining a magazine well and having an anterior portion;

a combination back strap and grip extender removably mounted on said grip, said combination comprising:

a strap positionable lengthwise along and overlying said anterior portion of said grip, said strap having first and second ends oppositely disposed, said first end being removably attached to said grip, said strap comprising an aperture positioned in said second end of said strap; and a grip extender mounted on said second end of said strap, said grip extender comprising a collar defining a lumen aligned with said magazine well when said strap overlies said grip.

6. The firearm according to claim 5, further comprising:

a hammer strut positioned within said grip;

a cup positioned within said grip;

a mainspring positioned within said grip and acting between said hammer strut and said cup;

a plunger mounted on said cup and extending through said aperture in said grip.

7. The firearm according to claim 6, further comprising:

a spur projecting from said first end of said strap, said spur engaging a recess in said frame; wherein said aperture receives said plunger, and engagement of said spur with said frame and said plunger with said aperture retains said combination to said grip.

8. The firearm according to claim 7, wherein said aperture is defined by a lug projecting from said second end of said strap.

9. The firearm according to claim 8, wherein said lug comprises a ramp surface surrounding said aperture, said ramp surface facing said plunger when said grip strap is retained to said grip.

10. The firearm according to claim 7, further comprising a plate mounted on said grip, said plate defining said aperture.

11. The firearm according to claim 10, wherein said plate has a plate surface facing said mainspring, said plate surface surrounding said opening and defining a line of motion along which said plunger moves, such that movement of said plunger toward said mainspring compresses said mainspring.

12. The firearm according to claim 6, wherein said mainspring comprises a coil spring surrounding an axis oriented parallel to said line of motion of said plunger.

13. The firearm according to claim 12, wherein said axis is coaxially aligned with said line of motion.

14. A method of attaching a combination back strap and grip extender to a grip of a firearm, said method comprising:

engaging a spur extending from a first end of a strap with a recess in said grip;

rotating said combination about said spur toward said grip;

engaging an aperture positioned in a grip extender with a plunger extending from an opening in said grip.

15. The method according to claim 14, further comprising biasing said plunger into engagement with said aperture using a mainspring of a trigger strut positioned within said grip.

16. The method of attaching a grip strap according to claim 14, further comprising moving said plunger toward said mainspring by engaging said plunger with a ramp surface mounted on said grip extender upon rotating said combination about said spur toward said grip.

17. A method of removing a combination back strap and grip extender from a grip of a firearm, said method comprising:

moving a plunger out of engagement with an aperture positioned in a grip extender;

rotating said combination away from said grip about a spur extending from a first end of a strap, said spur being engaged with a recess in said grip;

removing said spur from engagement with said recess.

18. The method according to claim 17 comprising moving said plunger out of engagement with said aperture by compressing a mainspring of a trigger strut positioned within said grip.

19. The method according to claim 17, wherein moving said plunger comprises inserting a tool into said aperture and engaging said plunger with said tool.

* * * * *